US005419632A

United States Patent [19]

Stephens

[11] Patent Number: 5,419,632

[45] Date of Patent: May 30, 1995

[54] METHOD AND APPARATUS FOR CONTINUOUS MIXING AND INJECTION OF FOAMED CEMENT GROUT

[76] Inventor: Patrick J. Stephens, 1276 Chuckanut Dr., Bellingham, Wash. 98225

[21] Appl. No.: 312,448

[22] Filed: Sep. 26, 1994

Related U.S. Application Data

[63] Continuation of Ser. No. 934,421, Aug. 24, 1992, abandoned, which is a continuation-in-part of Ser. No. 679,524, Apr. 2, 1991, Pat. No. 5,141,363.

[51] Int. Cl.[6] ..... B28C 5/38; E21D 11/10; E02D 29/00

[52] U.S. Cl. ..... 366/3; 366/51; 405/150.1; 405/267

[58] Field of Search ..... 405/132, 133, 146, 150.1, 405/150.2, 154, 155, 267; 366/3, 10, 12, 13, 51

[56] References Cited

U.S. PATENT DOCUMENTS

| | | | |
|---|---|---|---|
| 1,778,099 | 10/1930 | Webb . | |
| 2,492,045 | 10/1947 | Bellows . | |
| 2,995,901 | 8/1961 | Kemper . | |
| 4,280,771 | 7/1981 | Schwing et al. . | |
| 4,365,781 | 12/1982 | Johannson . | |
| 4,516,879 | 5/1985 | Berry et al. . | |
| 4,586,823 | 5/1986 | Schondorfer et al. | 366/3 |
| 4,652,174 | 3/1987 | Cornely et al. . | |
| 4,710,058 | 12/1987 | Han . | |
| 4,793,736 | 12/1988 | Thompson et al. . | |
| 4,801,210 | 1/1989 | Gian | 366/3 X |
| 4,822,211 | 4/1989 | Shinoda et al. . | |
| 4,892,441 | 1/1990 | Riker . | |
| 4,915,541 | 4/1990 | Thompson et al. . | |
| 4,940,360 | 7/1990 | Weholt . | |
| 5,102,228 | 4/1992 | Vine-Lott | 366/3 |
| 5,141,363 | 8/1992 | Stephens | 405/150.1 |

FOREIGN PATENT DOCUMENTS

| | | |
|---|---|---|
| 0157760 | 10/1985 | European Pat. Off. . |
| 2500735 | 9/1982 | France . |
| 1947187 | 3/1970 | Germany . |
| 3225569 | 12/1983 | Germany . |
| 281681 | 7/1952 | Switzerland . |
| 8000811 | 5/1980 | WIPO . |
| 8202358 | 7/1982 | WIPO . |

*Primary Examiner*—David H. Corbin
*Attorney, Agent, or Firm*—Todd N. Hathaway

[57] ABSTRACT

An apparatus and method for the continuous generation and placement of a foamed cement grout. The assembly is mounted on a fixed or mobile frame. There is a continuous foam generator, and this supplies finished foam to an intake port of a screw-type, positive-displacement pump. Cement slurry is also supplied to the intake portion of the pump, and this is mixed with the foam in the body of the pump and discharged from this through a conduit to the injection site on a continuous basis. The ratios of foam and slurry can be adjusted on a continuous basis to compensate for variations in grout quality which are observed at the injection site. The assembly is also provided with an onboard power generator and a water pump for flushing the grout out of the injection lines.

21 Claims, 6 Drawing Sheets

300
302
304
306
308
310
312
314
318
320
322
326
328
334
334a
334b
334c
336
342
350
352
354
355a
355b
355c
356
357
358a
358b
360
362
364
366
368

336
348
462
338
472
470
474
464
344
342
476
312
314
372
460
466
370
374
304
306
376a
376b
376c
380
386
390
382
459
384a
384b
384c
478
400
318
457
328
330
308
310
332
334
326
408
404
406
412
458
402
398
418
414
416
396
394
480
436
420
456
454
452
424
432
434
442
446
338
426
444
440
448
450
428

METHOD AND APPARATUS FOR CONTINUOUS MIXING AND INJECTION OF FOAMED CEMENT GROUT

RELATED APPLICATIONS

This is a continuation of applications Ser. No. 07/934,421, filed on Aug. 24, 1992, now abandoned, which is a Continuation-In-Part application of application Ser. No. 07/679,524, filed Apr. 2, 1991, now U.S. Pat. No. 5,141,363.

BACKGROUND OF THE INVENTION

1. Field of the Invention

The present invention relates generally to apparatus and methods for filling voids with foamed cement grouts. More particularly, the present invention relates to an apparatus and method for the continuous mixing of foamed cement grout, and pumping this to a desired injection site.

2. Background Art

Foamed cement grouts have many applications in industry, such as for filling abandoned pipelines and other large voids in the earth, and for grouting of tunnel liners and similar structures. These grouts are formed by mixing a finished foam, which comprises a mass or aggregate of bubbles, with a cement slurry so that air spaces are entrained within the grout. Because of the relatively large volume of the entrained air, the amount of cement slurry which is needed to fill a particular cavity is greatly reduced from that which would be needed if an unfoamed slurry was used. This results in great cost savings, especially when filling very large voids. Other advantages of foamed cement grouts include the fact that, because they are fluid and non-shrinking, the need for contact grouting is eliminated.

Although foamed cement grout is thus a highly advantageous material for grouting, backfilling, void filling, and so forth, its success in many of these applications has been limited to a significant degree by the manner in which it is conventionally prepared. In short, to the best of Applicant's knowledge, foamed cement grouts have always been prepared for fill work by batch-type processes: the foam is typically mixed into the cement slurry in a tub or other vessel to form a batch of the grout, which is then pumped from this to the injection site.

This batch-process approach exhibits certain inherent inefficiencies and disadvantages, especially when it comes to large fill jobs. While it may be possible to prepare batches of foamed cement grout which are big enough to complete relatively small grouting jobs, this is simply not feasible in the case of larger jobs, such as the filling of abandoned pipelines, which may call for hundreds or thousands of cubic yards of grout. Obviously, the repeated starting and stopping which is involved in a batch process introduces a strong element of inefficiency on such projects, especially being that large crews of workers may be left standing idle between the injection of each batch.

Furthermore, the need to mix up separate batches of grout and inject these individually invariably leads to quality control difficulties. Apart from mix variations which occur inevitably from batch-to-batch, the batch-type processes are inherently incapable of permitting adjustment of the quality of the grout as it is being injected. For example, although the bubble structure of the fluid grout is very stable, and will withstand high pressures without loss of integrity, significant bubble loss may occur due to friction between the grout and the piping through which it is pumped. These friction losses are somewhat unpredictable, and naturally become more serious as pumping distances increase. The inability of the batch-type processes to adjust the quality of the grout (i.e., the foam content) to compensate for observed friction losses means that an entire batch of grout may be placed at the injection site with the foam structure being significantly deteriorated due to friction loss, resulting in a severe decrease in the volumetric yield of the batch.

Another serious problem which has been encountered with such conventional grouting systems, particularly when filling abandoned pipelines and other elongate voids, stems from their inability to deliver the grout continuously at a high volume rate over sustained periods. As was noted above, the bubble structure of the grout is very stable so long as there is free liquid in the mixture, and so this can be pumped at relatively high pressures. However, once hydration of the grout proceeds to the point where it takes an initial set, the bubble structure ceases to exist and is replaced by a simple void which is maintained only by the cement paste which surrounds it; if this is subjected to external pressure, as by the injection of additional grout adjacent to or on top of the first, the void structure is very easily collapsed, resulting in a severe loss of volumetric yield. Simply put, it is very difficult to avoid this when using a batch-type process, since the process is slow by its very nature and injection must periodically halt while another batch is being prepared, and the grout will continue to set up during these pauses; also the pumps and related equipment which are conventionally employed in these processes are not suited to high injection rates.

Accordingly, there exists a need for an apparatus and method for preparing foamed cement grout and pumping this to an injection site on a continuous basis, and not batch-wise. Also, there is a need for such an apparatus and method which will permit continuous monitoring and adjustment of the quality of the grout which is produced. Still further, there is a need for such an apparatus and method which will permit the grout to be injected at a sustained rate sufficiently high to avoid injection on top of previously-injected grout which has taken an initial set.

One specific application for foamed cement grout which was noted above is for the grouting or backfilling of tunnel liners. In most cases, a tunnel is not complete until a liner has been placed along the perimeter of the bored hole. In a typical technique, a tubular tunnel liner is placed within the cylindrical wall of the tunnel, which results in an annular cavity being formed between these.

It has been found advantageous to fill this cavity with foamed cement grout, but difficulties have been encountered when using this material in relatively long tunnels. The grout, once mixed, is usually relatively viscous, and tends to compress and cause friction and back-pressure when pumped through conduits. This difficulty becomes serious if it is necessary to pump the grout over great distances, as from the surface to an injection point far inside a tunnel. Attempts have been made to overcome these problems by mixing batches of foamed cement grout within the tunnel, as by transporting dry cement in bags to a small batch mixer inside the tunnel and then mixing this with water and foam to form the grout; however, this batch-type approach shares the disadvantages discussed above, being that it has proven exceedingly slow and expensive to practice, and it is very difficult to carry out with adequate quality control.

Accordingly, there exists a need for an apparatus and method for employing foamed cement grout to backfill tunnel liners which avoids the need to pump the grout over long distances into the tunnel bore. Furthermore, there is a need for such an apparatus and method for continuously forming and injecting such foamed cement grout within the tunnel, so that high volumes of grout can be placed over long distances quickly, and with a high degree of quality control.

SUMMARY OF THE INVENTION

The present invention has solved the problems cited above, and is an apparatus for the continuous generation and placement of a foamed cement grout, this comprising broadly: means for generating a finished foam on a continuous basis, means for mixing the finished foam with cement slurry on a continuous basis to form a foamed cement grout, and means for pumping the foamed cement grout to a selected injection site on a continuous basis.

The apparatus may further comprise means for selectively adjusting the ratio at which the finished foam is mixed with the cement slurry on a continuous basis so as to compensate for observed variations in the quality of the grout. This may comprise control means for selectively adjusting the rate at which the finished foam is outputted from the generating means to the mixing means.

The means for pumping the foamed cement grout may comprise a screw-type, progressive-cavity pump, and the means for mixing the finished foam with the cement slurry may be this pump, the pump having an intake portion which is configured to receive the foam and slurry, and a main body portion which is configured to mix the foam and slurry to form the grout as the foam and slurry move through the pump from the intake portion to a discharge portion. The intake portion of the pump may comprise an intake port for supplying the cement slurry to the intake portion of the pump at a first point along a direction of flow in the pump, and an intake port for supplying the finished foam to the intake portion of the pump at a second point which is spaced downstream along the direction of flow from the first point. There may also be conduit means for conveying the foamed cement grout from the discharge portion of the pump to the selected injection site.

The apparatus may further comprise frame means to which the foam generating means and pump are mounted. This frame means may be configured for placement in a stationary location from which the grout is pumped to the injection site, or the frame means may be configured for rolling movement from a first location to a second location so as to permit the foam generating means and pump to be positioned relatively closely adjacent the injection site.

There may also be means for selectively flushing the grout out of the conduit so as to prevent the grout from setting up therein. This may comprise pump means mounted to the frame for selectively generating a stream of high pressure water, and a conduit for directing this stream from the discharge end of the pump into the main conduit so that the stream of water flushes the grout out through a discharge end thereof.

A method is also provided for the continuous generation and placement of foamed cement grout, this comprising broadly the steps of: generating a finished foam on a continuous basis, mixing the finished foam with a cement slurry on a continuous basis to form a foamed cement grout, and pumping the foamed cement grout to a selected injection site on a continuous basis.

The method may further comprise the step of selectively adjusting the ratio at which the finished foam is mixed with the cement slurry on a continuous basis, so as to compensate for observed variations in the quality of the grout. This step may comprise adjusting the rate at which the finished foam is outputted and then mixed with the cement slurry.

The method may also further comprise the step of injecting the grout at the injection site at a sufficiently high rate that the injection site is filled continuously without injecting fresh grout under pressure adjacent previously-injected grout which has taken an initial set, so as to avoid collapsing void spaces in the previously-injected grout due to the injection pressure of the fresh grout.

The step of mixing the finished foam with the cement slurry may comprise supplying the foam and the slurry to an intake portion of a screw-type, progressive-cavity pump, and mixing the foam and the slurry in a main body portion of the pump as the foam and slurry move through the pump to a discharge portion. The step of supplying the foam and slurry to the intake portion of the pump may comprise supplying the cement slurry to the intake portion of the pump through an intake port at a first point along a direction of flow in the pump, and supplying the finished foam to the intake portion of the pump through an intake port at a second point which is spaced downstream along the direction of flow from the first point.

These and other novel features and advantages of the present invention will become apparent from the following detailed description, wherein reference is made to the Figures in the accompanying drawing.

DETAILED DESCRIPTION a. Mobile Plant i. Overview

Figure 1:
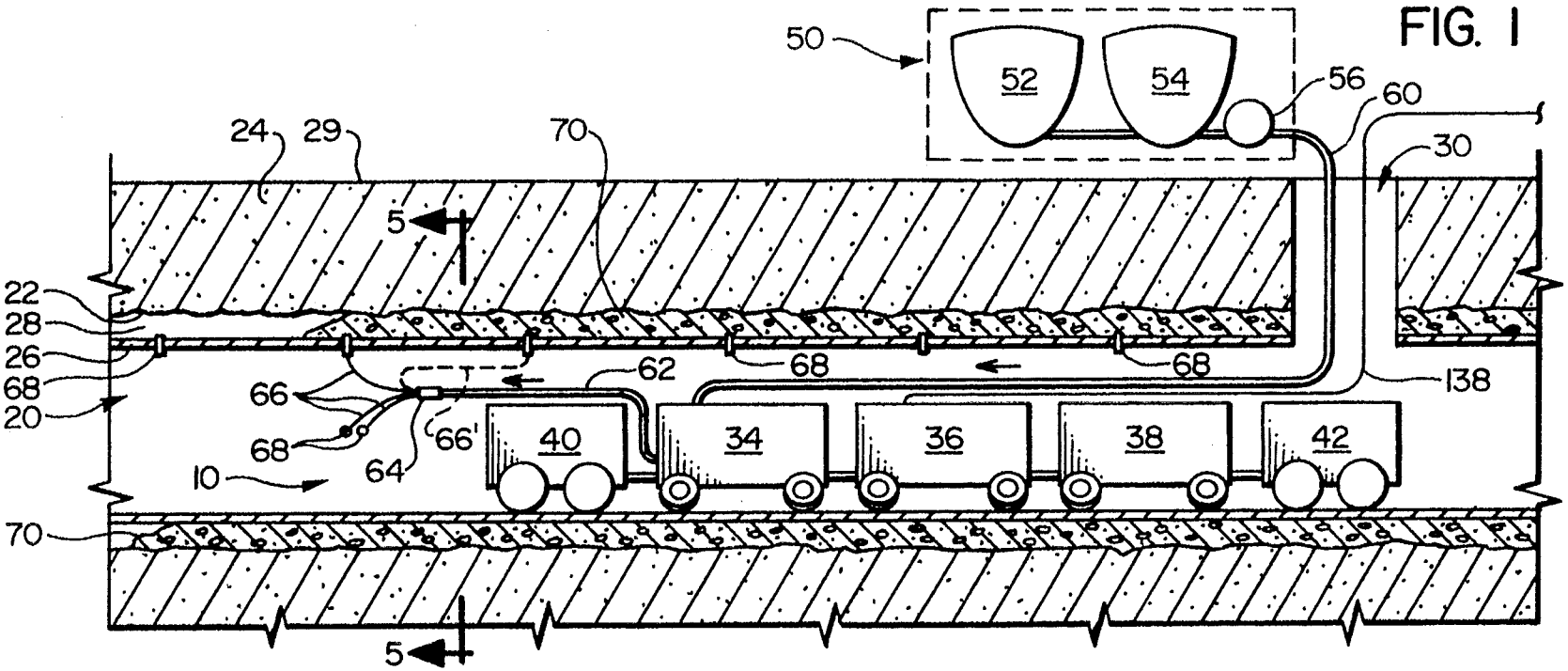
FIG. 1 is a cross-sectional view of a tunnel having a mobile grouting machine in accordance with the present invention positioned therein, this being supplied with cement slurry from a surface mixing plant.

FIG. 1 shows a mobile grouting machine 10 in accordance with the present invention, this being positioned for longitudinal movement in a subterranean tunnel 20. Tunnel 20 comprises generally a cylindrical bore 22 formed in earth formation 24, and a cylindrical liner 26 which has been installed in the bore. The liner 26 is necessarily smaller than bore 22 so as to permit this to be installed, and an annular gap 28 is consequently formed between the liner and bore. Access is gained to the tunnel from surface 29 via a shaft 30.

Grouting machine 10 is positioned inside liner 26, and comprises generally a train of wheeled cars 34, 36, 38. By using three cars arranged in a train, it has been found possible to configure the equipment so that it will fit within a relatively small-diameter (e.g., 6-foot diameter) liner, and this also provides sufficient flexibility that the train will accommodate bends in the tunnel; however, for relatively large-diameter (e.g., 12.5-foot diameter) tunnel liners, it may be preferable to mount the equipment on a single car.

A tractor 40 is attached to one end of the train to pull the cars through the tunnel. A second tractor 42 may be attached to the other end of the train to pull it in the other direction, and this can also be used to bring loads of liquid foam concentrate or other materials to the train while it is in operation. Tractors 40 and 42 may preferably be conventional diesel-powered front loaders. Of course, other locomotive devices may be substituted for tractors 40, 42, including, for example, winches having cables attached to the train.

The wheeled cars carry the equipment for generating finished foam and mixing this with cement slurry which has been pumped to the train from a remote source. As is shown in FIG. 1, the cement mixing plant 50 is typically positioned on the surface, outside of the tunnel. The plant includes a dry cement hopper 52 and a water hopper 54, the contents of which are mixed to form the slurry. An output pump 56 discharges the fluid cement slurry from the mixing plant under pressure. Inasmuch as such conventional cement mixing plants are well known to those skilled in the art and do not themselves form part of the present invention, mixing plant 50 will not be described in greater detail.

A conduit 60 conveys the slurry from pump 56 to grouting machine 10. Because the unfoamed cement slurry is relatively fluid, it is easily pumped over the relatively great distances from access shaft 30 to grouting machine 10, without developing the excessive pressures which would be encountered in pumping foamed cement grout over such distances; for example, the slurry can readily be pumped in excess of 10,000 lineal feet, and pumping distances on the order of 30,000 feet can be attained if suitable high pressure conduit is available. In order to further facilitate this pumping, it has been found advantageous to form conduit 60 of low-friction, segmented, steel pipe known to those skilled in the art as "slickline".

The cement slurry which is pumped through conduit 60 feeds machine 10 on a continuous basis, and this is mixed with finished foam to produce the foamed cement grout. This is then pumped through a second conduit 62 (which may be another "slickline") to a grout distribution manifold 64, this distance being up to about 3,000–4,000 lineal feet. From the manifold, the grout is distributed to a plurality of relatively short injection hoses 66. The end of each of the injection hoses is inserted through a port 68 in liner 26 so as to be in fluid communication with annular cavity 28. The injection hoses are preferably flexible, so that they can be bent back on themselves from manifold 64 to a first injection port, in the position shown by broken line image 66', and can also extend down the tunnel from the manifold to a second injection port, in the position shown by solid line image 66, without having to move manifold 64 or cars 34, 36, 38.

Because the foamed grout need only be pumped relatively short distances through conduit 62 and hoses 66 before it is injected into the cavity, the viscosity and resistance to pumping which are exhibited by this material do not present the problems which they would if greater distances were involved.

In a typical application, machine 10 may start at an initial position near a set of injection ports 68 close to the opening into the tunnel, first injecting foamed cement grout into these and then moving sequentially to positions further along the length of the tunnel. By this approach, a uniform and effective grouting of the annular cavity over the whole length of tunnel 20 can be achieved expeditiously and efficiently. The continuous injection of grout over each segment which is made possible by machine 10 enables a heretofore unknown rate of backfilling and control over the quality of the backfill material to be achieved.

ii. Systems Description

Having provided an overview of the grouting machine of the present invention, a number of the components thereof will now be described in greater detail.

Figure 2:
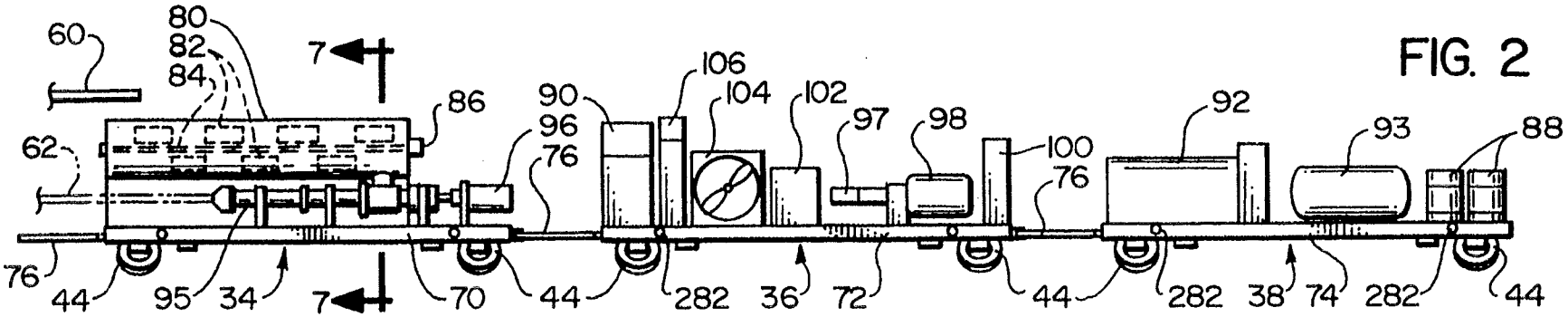
FIG. 2 is an elevational view of the wheeled cars making up the grouting machine of FIG. 1, showing the individual components mounted thereon.

FIG. 2 shows cars 34, 36, and 38 of grouting machine 10. Each of these comprises a platform 70, 72, 74, on which the mixing, pumping, and other related components are mounted, and which rides on wheels 44 which perpendicularly engage the wall of the tunnel liner. The cars are connected to one another by means of tow bars 76.

The cement slurry which is supplied to machine 10 through conduit 60 is discharged into a hopper 80, which provides a constant supply of cement slurry to the mixing and pumping apparatus of the machine; the hopper is sized sufficiently large that the supply of slurry therein "smooths out" variations in the flow of cement from the surface mixing plant. A series of paddles 82 are attached to a shaft 84 which is rotated by a hydraulic motor 86, so that these agitate and remix the slurry in hopper 80.

The slurry from hopper 80 is mixed with finished foam to produce foamed cement grout. Conventional finished foams are made by mixing liquid foam concentrate with air and water; turning then to FIG. 2, we see that a supply of foam concentrate is carried on car 38 in drums 88. The concentrate is fed from these to the foam generator 90, and the water is supplied to generator 90 by means of a hose which is run through the tunnel. Air, in turn, is supplied by an air compressor 92, and the foam generator mixes these to produce the finished foam. This is pumped from generator 90 to grout discharge pump 95. The cement slurry is also fed into pump 95 from hopper 80, and the finished foam and cement slurry are mixed together in this to form the foamed cement grout. This is then discharged through line 62 to the manifold and injection lines.

Power is provided for the grout pump motor and other hydraulic motors of machine 10 by a hydraulic pump 97 mounted on car 36. Pump 97 draws fluid from reservoir 102, and a cooler 104 is installed to keep the temperature of the fluid within proper parameters. The pump is driven by an electric motor 98; this receives its power from an electrical panel 100, to which power is supplied by cables which extend through the tunnel. In other embodiments, a generator may be mounted on the cars to provide the electrical power, or an engine may drive the hydraulic pump directly. Alternatively, the various systems may be operated by electric or air motors.

Figure 3:
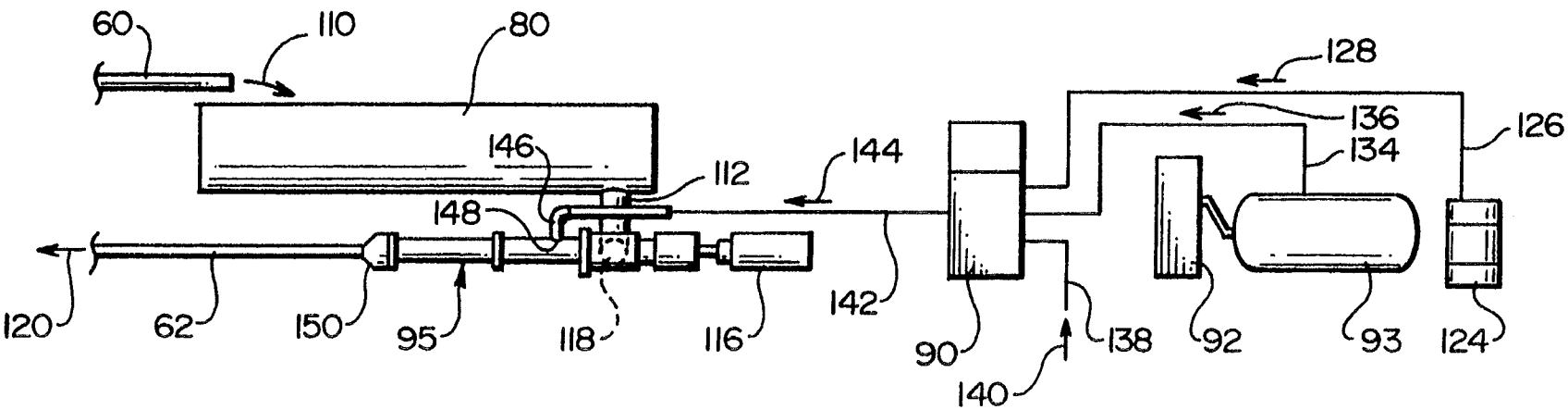
FIG. 3 is a schematic view showing the systems of the machine of FIG. 1 which generate finished foam and mix this with cement slurry on a continuous basis to form the foamed cement grout.

FIG. 3 provides a more detailed view of the systems for generating the foam and mixing this with the cement slurry. As was noted above, the cement slurry is discharged into hopper 80, in the direction indicated by arrow 110: from here the slurry flows through throat 112 into an intake port 118 at the suction end of pump 95; the vertical drop between the hopper and the intake serves to provide the pump with a constant head of supply pressure. It has been found advantageous in some embodiments to route throat 112 along a somewhat circuitous path so as to help prevent the foam from bubbling back up through this.

Pump 95 itself is preferably a progressive-cavity, screw-type pump, this preferably being operated by a hydraulic motor 116 so as to provide a wide range of available speeds (i.e., rpm's); a pump of this configuration facilitates mixing of the foam and slurry within the body of the pump, and also contributes to the rapid grout output rate of the system, as will be discussed in greater detail below. A pump of this type which has been found eminently suitable for this application is a Model L-12 rotor-stator type "Moyno" pump available from Robbins & Meyers, Inc., Dayton, Ohio, and so pump 95 may be referred to from time-to-time hereinafter as a "Moyno" pump.

From intake 118, the slurry moves longitudinally through Moyno pump 95 in the direction indicated by arrow 120, and downstream of intake 118, but still on the suction side of the pump, the finished foam is also fed into the pump cavity. It has been found preferable to position foam intake port 148 some distance downstream of the slurry intake port 118, because this also helps prevent the finished foam from "bubbling" back up through throat 112. Downstream of the foam injection point, the slurry and foam are mixed proportionally within the body of the Moyno pump by the action of its screw pump mechanism, so as to form well-mixed foamed cement grout. This is discharged through the discharge end 150 of the pump, and into grout discharge line 62 in the direction indicated by arrow 120; additional mixing and homogenization of the foamed grout continues to take place within the first 100 feet or so of the discharge line.

It should be noted at this point that, while the Moyno-type pump described above has been found preferable for mixing and pumping the grout in the present invention, suitable pumps of other types, such as piston pumps or squeeze pumps, may be substituted for this, with or without a supplemental mixer for the foam and slurry.

FIG. 3 also illustrates the foam-generation side of the system. As was noted above, the finished foam is generated from a mixture of foam concentrate, water, and air. An exemplary foam concentrate which is suitable for use in the present invention is available from the Mearle Corporation, Roselle Park, N.J., under the trade name "Mearle Geocel Foam Liquid". The liquid concentrate is drawn from container 124 by a suction line 126 which is connected to the foam generator unit 90. The compressed air is supplied to the generator unit from a reservoir 94, through line 134, and finally, the water is supplied through line 138. The foam generator unit meters the concentrate, compressed air, and water, and mixes these to form the finished foam. A generator unit which has been found eminently suitable for this is a Model AFS-2H-20V Autofoam TM unit, also available from the Mearle Corporation. The Autofoam TM unit is equipped with pumps for drawing the foam concentrate to the unit and mixing the foam, and for discharging the finished foam through line 142, in the direction indicated by arrow 144.

The finished foam line 142 discharges through a conduit 146 into the suction side of the Moyno pump at foam intake port 148. The proportions of the cement slurry and foam supplied to the pump are regulated according to the specifications for a particular project: for example, the following mix design has been found suitable for grouting tunnel liners using the machine described above:

| | | |
|---|---|---|
| Cement Slurry | | |
| Cement | 341 lbs. | 1.740 CF |
| Fly Ash | 341 lbs. | 2.368 CF |
| Water | 362 lbs. | 5.801 CF |
| Foam | | |
| Foam | 35.7 lbs. | 17.090 CF |
| Total | | 27 CF or 1 cu. yard |

This provides a grout having a water-solids ratio of about 0.53 and a wet density of about 40 PCF.

The systems of the present invention may thus be provided with an initial setting such that the quality of the grout which is produced approximates what has been specified for a particular job. However, as was noted above, various factors, such as loss of bubble structure due to friction with the pumping line, may cause the quality of the grout at the injection site to vary significantly from what is produced at the discharge end of the main pump. Accordingly, it is an important aspect of the present invention that the quality of the grout which is produced at the pump outlet can be adjusted on a continuous basis to compensate for such losses or other factors, so that the quality of the grout at the injection site can be maintained continuously within proper parameters. The systems of the present invention make this possible, primarily by permitting continuous adjustment of the quality and quantity of finished foam which is produced by the foam generator, and which is injected into the continuous flow of slurry through the pump. The variable speed of the pump provides another control factor. Therefore, for example, if the operators at the injection site weight the grout and determine that it is being delivered at that point with insufficient foam content, so that its unit weight is too high, the rate at which the foam is produced can be increased almost instantaneously (by telephone directions) so as to increase the proportion of foam in the grout to compensate for the loss. Conversely, if the grout at the injection site is observed to be too light due to excess foam content, the proportion of foam can be reduced at once to compensate for this. Accordingly, variations in the quality of the grout can be corrected on a continuous basis, as opposed to the situation which occurs in a batch-type process, where perhaps an entire batch of grout would have to be injected before the problem could be corrected, or (if it is too far out of specification) dumped into the tunnel bore for subsequent disposal.

b. Stationary Plant i. Overview

The foregoing description has focussed an embodiment of the present invention in which the apparatus for continuously generating and injecting the foamed cement grout is mounted on a mobile train. FIGS. 4–7, in turn, illustrate another embodiment in which the continuous foam generating and pumping assemblies are constructed for stationary operation, and which is especially suited for large-volume filling projects. In this embodiment, the foamed cement grout is pumped from the stationary mixing apparatus to the injection site, and so this is particularly suited to applications where the pumping distances are not too great; for example, being that the foamed grout can be pumped some 3,000–4,000 lineal feet without difficulty, this embodiment is especially suited to tunnel grouting jobs where the distances between adjacent access shafts is 8,000 feet or less. Also, the stationary plant may be more economical for many projects, being that there is less equipment to transport than in the case of the mobile machine, and it requires fewer personnel to operate.

Figure 4:
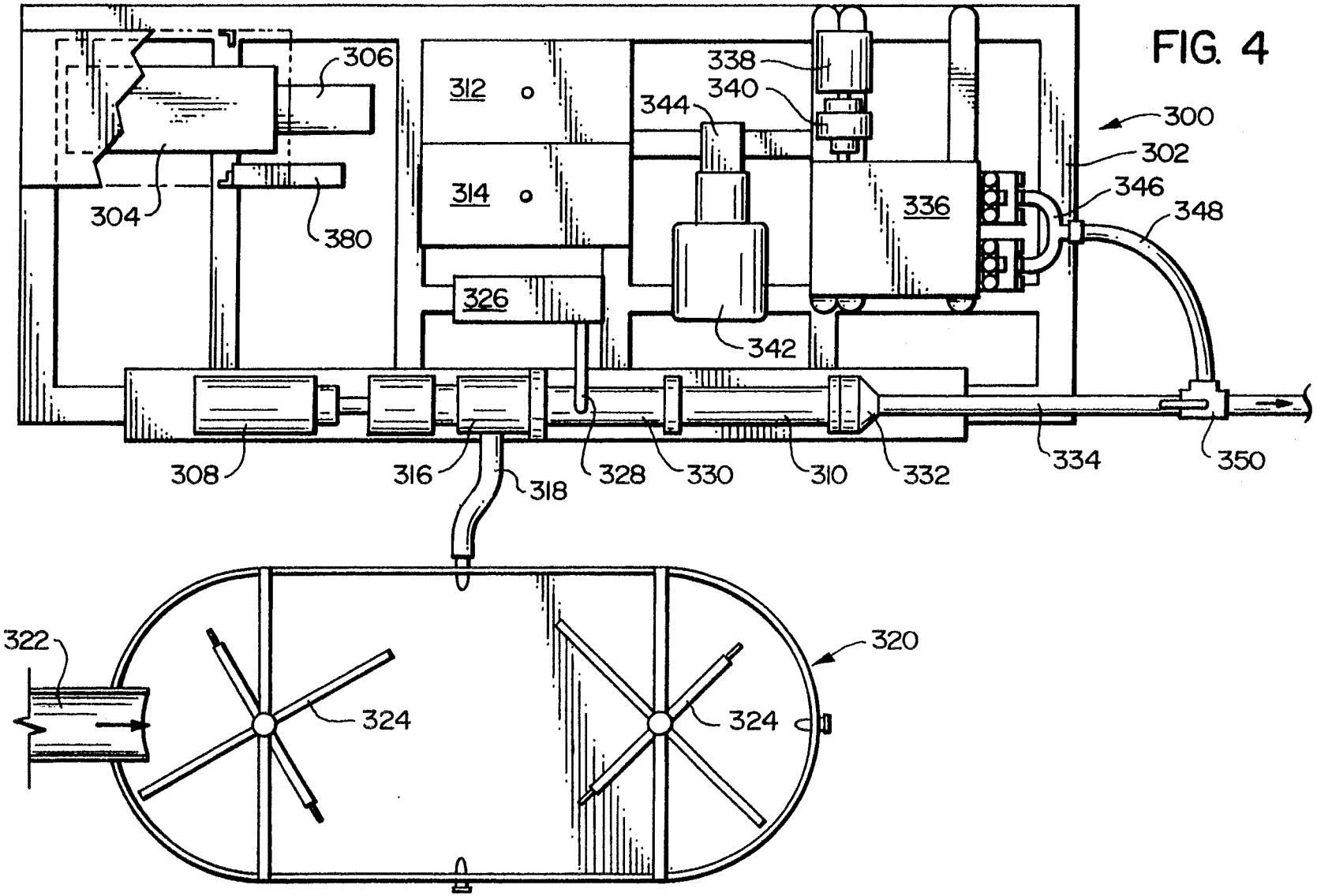
FIG. 4 is a plan view of a second embodiment of continuous grout mixing and pumping machine in accordance with the present invention, this being mounted on a stationary frame at an above-ground location.

Accordingly, FIG. 4 shows an overhead view of continuous grout generating and pumping assembly 300 mounted on a stationary frame 302. The primary power source for this assembly is a diesel engine 304 which operates a hydraulic pump 306. Hydraulic fluid storage tank 312 provides a supply of fluid for pump 306, and diesel fuel is supplied from fuel tank 314. The hydraulic pressure from pump 306 drives several motors of the assembly. Chief amongst these is drive motor 308 for Moyno pump 310. This is substantially similar to the Moyno pump described above, although possibly having a somewhat larger capacity; for example, a Robbins & Meyers 2000 Series Moyno pump has been found eminently suitable for this application, this having a rated capacity of 100 gal. @100 rpm.

As previously described, the cement slurry is fed into the intake end 316 of the Moyno pump through a slurry supply conduit 318. In the embodiment which is illustrated, the supply conduit is connected to a slurry tank 320 which is filled by periodic deliveries from slurry trucks, the discharge chute 322 of one of these being seen in FIG. 4. As is also shown, slurry tank 320 may be provided with rotating paddle assemblies 324 which insure homogenization of the slurry and prevent it from setting up, much in the same manner as the corresponding paddle assemblies in the slurry hopper described above. However, it will be understood that any suitable means for providing a steady supply of slurry to assembly 300 may be substituted for the slurry tank 320 which is shown in FIG. 4, including, or example, a conventional mixing plant of the type described above.

The finished foam, in turn, is provided by foam generator assembly 326, the output of which is injected through foam conduit 328 into an intake portion 330 of Moyno pump 310 which is downstream of the slurry intake, but still on the intake side of the pump. In the same manner as was described above, the foam and slurry are mixed within the body of the Moyno pump to produce the foamed cement grout, and then this passes through the discharge end 332 of the pump into injection line 334.

Assembly 300 is also provided with an auxiliary flushing or "blowdown" system for flushing the grout out of the injection lines in the event of failure of the main pumping system, or for simply cleaning out the lines upon completion of the work. This comprises a reciprocating pump 336 (which may be, for example, a "frac" pump commonly available from oil field service companies) which is driven by a hydraulic motor 338 through coupling 340. Power is supplied to this by an electric motor 342 driving a dedicated hydraulic pump 344; motor 342 receives its power from power cables (not shown), and this consequently provides a power source independent of the main hydraulic system of assembly 300, so that pump 336 will continue to be operable in event of failure of the main system.

Pump 336 is used to selectively flush the grout out through the downstream end of injection line 334, so as to prevent this from setting up in the line and ruining it. To do this, motor 342 is energized to provide hydraulic power to motor 338 (alternatively, power may be supplied from engine 304 and pump 306), and water is supplied to the intake (not shown) of pump 336. The discharge ports of the pump are connected via a manifold 346 and jumper hose 348 to a diverter valve 350 mounted in line 334. During normal operation of the machine, valve 350 is aligned to direct the discharge from the Moyno pump through injection line 334; then, when flushing pump 336 is being operated, valve 350 is realigned to direct the flow from jumper hose 348 into injection line 334 so that water flows through this and displaces the grout.

Figure 5:
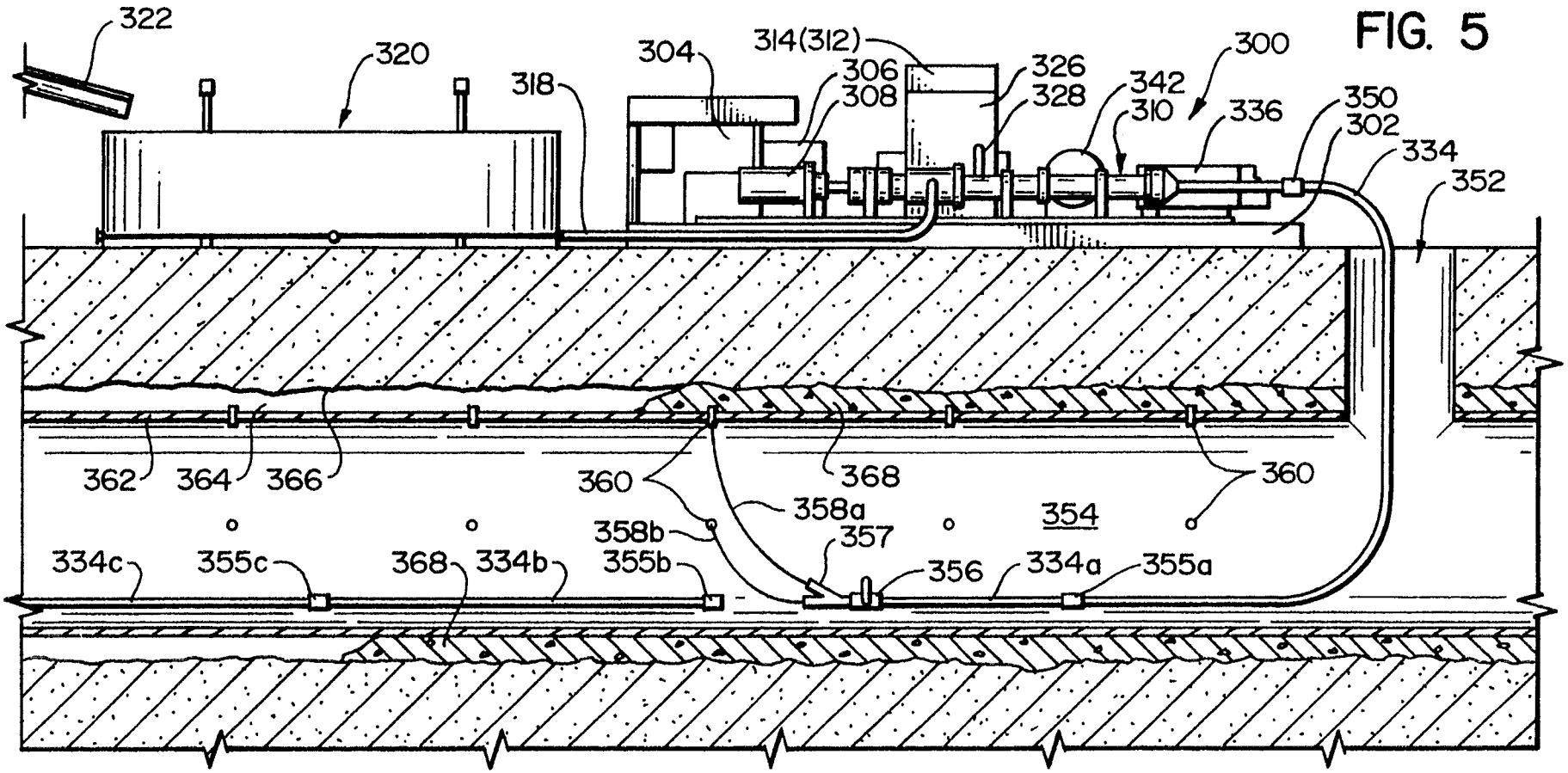
FIG. 5 is an elevational view, partly in cross-section, showing the machine of FIG. 4 employed in the grouting of a tunnel liner.

FIG. 5 shows assembly 300 employed in an exemplary application, namely the grouting of a tunnel liner similar to that described above. Accordingly, FIG. 5 shows the injection line 334 extending through an access shaft 352 and into tunnel bore 354. Within the bore, the injection line is laid out in a series of segments 334*a,b,c,* etc., of a given length (e.g., 250 feet), these being joined by couplings 355*a,b,c.* To inject the grout sequentially along the tunnel, a first coupling 355 is broken, and a ball valve 356 and manifold 357 are mounted on the end of the injection line 334. Depending on the number of injection ports to be serviced, manifold 357 may be a single hose or a simple Y-fitting, as shown in FIG. 5, or this may be provided by one or more lateral connections connected in a series and having a Y-fitting at their end. The manifold supplies grout to a plurality of injection hoses 358. The ends of the injection hoses, in turn, extend through injection ports 360 formed in tunnel liner 362 so as to inject the grout into an annular space 364 between this and the wall 366 of the excavation. The grout 368 flows longitudinally through the annular cavity, and when grouting of a given segment of the tunnel has been completed, the ball valve 356 is closed to discontinue injection of the grout. Pumping is then temporarily halted while the broken fitting 355 is reconnected, and then the ball valve, manifold, and injection hoses are moved down the tunnel to the next coupling; this is then broken in the same manner as the preceding coupling, and the valve and manifold are connected to the injection line 334 at this point so that pumping of the grout can begin again. In this manner, the entire length of the liner can be grouted by moving the manifold and hoses sequentially through the length of the tunnel, from one connection 355 to the next. However, it will be understood that it may be preferable in some applications to pre-install the ball valves, manifold, and hoses at the junctions along line 334, as on T-fittings; this would permit the liner to be grouted by simply opening the valves sequentially along the length of the tunnel, although this would also necessitate the cleaning of additional equipment upon completion of the job.

Accordingly, it will be understood that the stationary assembly 300 may be employed for a continuous grouting of a tunnel liner in place of the mobile assembly described above, although it may be desirable to lower the entire assembly 300 on frame 302 down the shaft and into the tunnel so that this will located at a site which is relatively closer to the injection points than is shown in FIG. 5.

b. Systems Description

Figure 6:
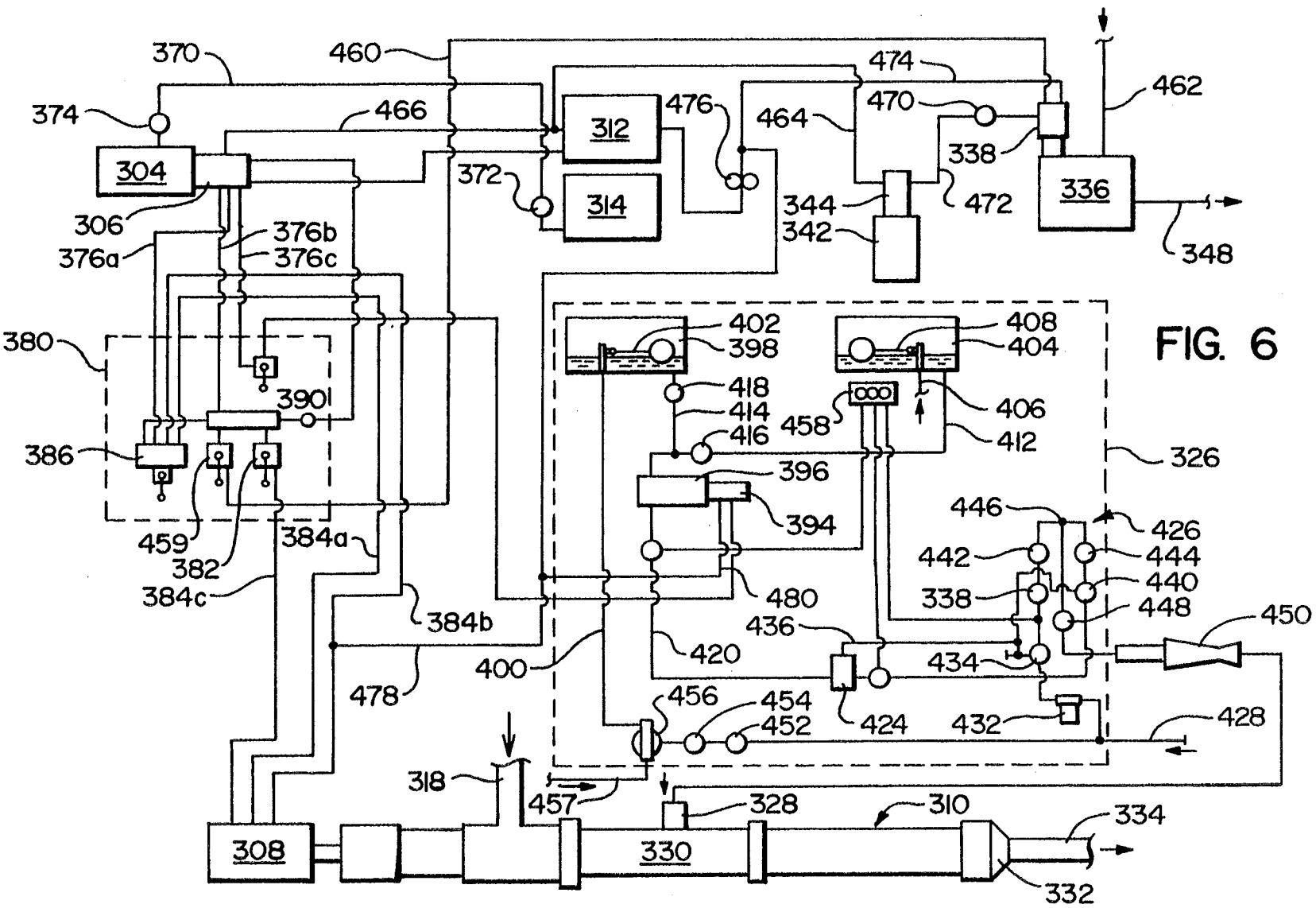
FIG. 6 is schematic view of the hydraulic system of the machine of FIGS. 4–5.

Having provided an overview of the stationary grout generating and pumping assembly 300, the systems which make this up will now be described in greater detail. FIG. 6 shows a diagrammatical view, somewhat simplified, of the hydraulic and other systems of the assembly, and how these are related. As was noted above, the primary power source for the assembly is the diesel engine 304, and this receives fuel from tank 314 through fuel line 370, via cutoff valve 372 and fuel/water separator 374. The output of the hydraulic pump 306 which is driven by the engine is directed via pressure supply lines 372*a–c* to a control station indicated schematically at 380 (see also FIG. 4). A first control valve 382 selectively directs the hydraulic pressure through supply lines 384*a–c* to drive motor 308, and these, in conjunction with a directional valve 386, control the speed and direction of rotation of the Moyno pump 310.

A third control valve 390 selectively supplies hydraulic pressure through line 392 to the foam generator assembly 326. The construction of foam generator assembly 326 will be outlined here to provide the reader with fuller understanding of how the systems of assembly 300 operate; however, it will be understood that a conventional foam generator unit may be employed in this system, such as the Mearl Autofoam TM unit described above.

The pressure supplied through line 392 operates a hydraulic motor 394 which drives a pump 396, and this mixes the foam concentrate and water and discharges this under pressure. Foam concentrate is supplied to this from a concentrate tank 398; the foam concentrate is supplied to the tank through line 400, this flow being controlled by a float valve 402 so as to maintain the desired level of liquid in the tank. Similarly, the assembly includes a water tank 404, to which water is supplied via line 406 and float valve 408.

Mixing pump 396 draws water and foam from tanks 404 and 398 through gravity feed lines 412 and 414, with the flow being controlled by metering valves 416 and 418, respectively. The water and foam concentrate are mixed in the proper ratio (e.g., 96:4) by pump 396, and are discharged from this through line 420. This passes through a backflow-preventer check valve 424, and into the first side of a blending subcircuit 426. Pressurized air from a compressor or supply hose enters the other side of the subcircuit through air supply line 428. The air pressure passes through a water trap 432 to an operating valve 434; when this opened, this distributes air pressure through line 436 to check valve 424 and air-actuated cutoff valves 438, 440 so as to open these simultaneously. This initiates the simultaneous flow of air and water/foam concentrate into the blending subcircuit; the two fluid streams pass upwardly through flow control gate valves 442, 444 to junction 446, where they merge and mix. The flow then passes back downwardly through the main control valve 448, and thence through foam nozzle assembly 450 to produce the finished foam. As was described above, the finished foam is then delivered into Moyno pump 310 through foam conduit 328.

A second branch from air supply line 428 passes through cutoff and speed control valves 452 and 454 to drive air-operated concentrate pump 456; this draws fluid through line 457 and discharges it through line 400 into concentrate tank 398. A gauge panel 458 monitors the air pressure and other operating pressures within the generator assembly.

The final subsystem of assembly 300 is the flushing or "blowdown" pump. A control valve 459 is provided in control station 380 for this, and this selectively directs a supply of hydraulic pressure from the main hydraulic pump 306 through line 460 to operate reciprocating pump 336. This pressurizes water which is supplied thereto through water line 462, and discharges this to the injection line through jumper 348. As was also noted above, this subsystem is intended to be able to operate independently of the remainder of assembly 300, and so a separate electric motor 342 and hydraulic pump 344 are also provided for this. These draw hydraulic fluid from hydraulic reservoir 312 through an intake line 464, in much the same manner that the main hydraulic pump does so through its own intake line 466. A control valve 470 controls the flow from pump 344 through line 472 to motor 338, and thence the low pressure fluid returns to reservoir 312 through return line 474. The return flow passes through a filter 476 to remove impurities, and the return lines 478 and 480 from drive motors 308 and 394 similarly return to the hydraulic tank through this filter.

Figure 7A:
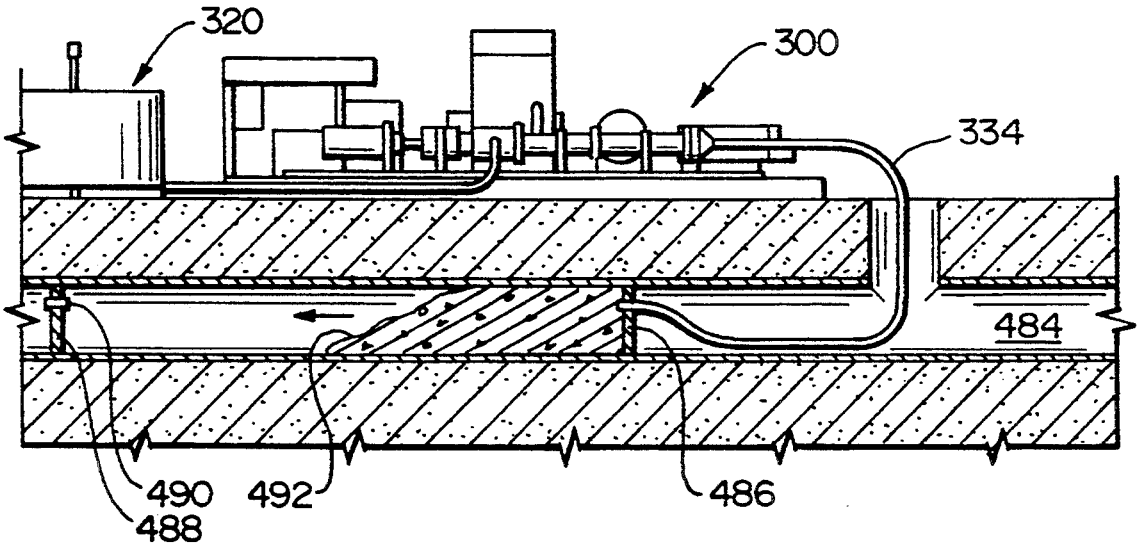
FIG. 7A is an elevational view similar to that of FIG. 5, but to a reduced scale, showing the machine of FIGS. 4–5 employed in the filling of an abandoned pipeline.
Figure 7B:
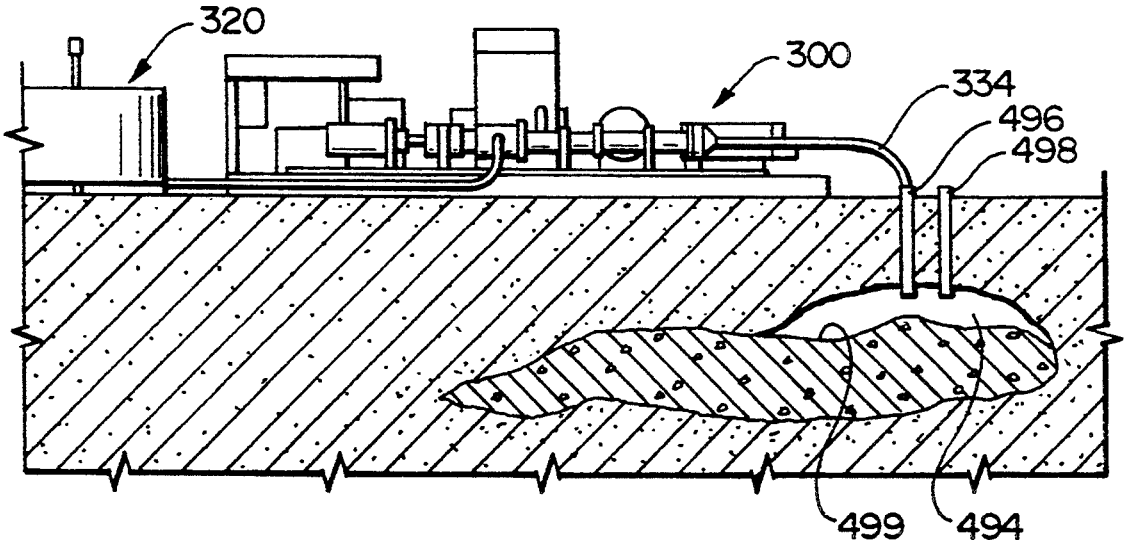
FIG. 7B is a view similar to FIG. 7A, showing the machine being used to fill a void in the earth.

From the foregoing description, it will be apparent that an apparatus for effectively generating and injecting foamed cement grout on a continuous basis has been disclosed herein. As was noted above, this system has a great many potential applications, in addition to grouting tunnel liners. FIGS. 7A and 7B demonstrate two of these possible uses, and also illustrate how the rapid output rate of the machine of the present invention serves to avoid the problem of pumping on top of grout which has taken an initial set.

For example, FIG. 7A shows the apparatus 300 being employed to entirely fill an abandoned pipeline 484 with grout. First and second dams or bulkheads 46, 48 are installed at longitudinally spaced apart locations within the tunnel; the end of the injection line 334 is inserted through one of these, and a vent 490 is formed in the other. The machine 300 is energized and grout is pumped through the injection port. As this is done, the grout builds up behind the bulkhead and forms a front 492 which advances through the tunnel bore toward the other bulkhead, in the direction indicated by the arrow in FIG. 7A; the air which is displaced by this front escapes through vent 490. Because the machine 300 is able to produce the foamed cement grout on a continuous basis and also injects this at a high rate, the front 492 is able to advance a relatively great distance down the tunnel bore before the initially injected grout begins to take an initial set, thus avoiding pumping fresh grout on top of this and causing collapse of the void structure. Accordingly, the bulkheads 486, 488 may be spaced a relatively great distance apart, and the abandoned tunnel can be filled in relatively long segments, resulting in significant economic advantages.

Similarly, FIG. 7B shows machine 300 being used to fill a cavern 494 with grout. The cavern is penetrated by an injection pipe 496 and a vent pipe 498; the injection line 334 is led down the first pipe so as to inject grout into the cavity, and the displaced air escapes therefrom through the second. The tremendous volumes of grout which are required to fill such a cavity render the machine of the present invention highly advantageous simply from the standpoint of it being able to produce large amounts of grout on a continuous basis, but again, the high injection rates make it impossible to fill the cavity without pumping material on top of grout which has taken an initial set and causing this to collapse: as the grout is pumped into the cavern, the upper surface 499 of this moves upwardly to fill a relatively great portion of the cavity before the initially injected grout in the lower portions take an initial set. In the event that the cavern is so large that it cannot be completely filled before the bottom-most grout begins to set, injection can be terminated for a period of time (e.g., overnight) until the first layer has completely set up, and then injection can commence again; even though this represents a step-wise approach to filling the cavity, the fact that the system of the present invention can fill a much greater portion of the cavity before having to shut down for the grout to harden then would be possible using a batch-type process means that the cavern can be filled in far fewer stages.

Many possible embodiments may be made of the present invention without departing from the scope thereof; for example, the grouting apparatus and method of the present invention may be applied to the construction industry, such as for the fabrication of cement roof deck structures. It is therefore to be understood that all matter herein set forth or shown in the accompanying drawings is to be interpreted as illustrative and not in a limiting sense. It will be understood that certain features and subcombinations are of utility and may be employed without reference to other features and subcombinations. This is contemplated by and is within the scope of the appended claims.

What is claimed and desired to be secured by Letters Patent of the United States is:

1. An apparatus for the high capacity continuous generation and placement of a foamed cement grout, said apparatus comprising:

means for providing a supply of cement slurry on a continuous basis;

means for generating a supply of finished foam on a continuous basis;

positive displacement pump means having (a) an intake side, (b) a discharge side, and (c) a body portion which is configured to mix said slurry and said foam therein as said foam and said slurry flow from said intake side to said discharge side of said pump means;

means for feeding said cement slurry and said finished foam substantially separately to said intake side of said pump means on a continuous basis, so that said slurry and said foam are mixed within said body portion of said pump means so as to form said foamed cement grout on a continuous basis; and conduit means for conveying said foamed cement grout from said discharge side of said pump means to a selected injection site on a continuous basis.

2. The apparatus of claim 1, further comprising:

means for selectively adjusting a ratio at which said finished foam is mixed with said cement slurry on a continuous basis so as to compensate for observed variations in the quality of said grout.

3. The apparatus of claim 2, wherein said means for selectively adjusting said ratio at which said finished foam is mixed with said slurry comprises:

control means for selectively adjusting a rate at which said finished foam is fed from said generating means to said pump means.

4. The apparatus of claim 3, wherein said positive displacement pump means comprises a screw-type, progressive-cavity pump through which said slurry and said foam flow in a generally linear direction from said intake side to said discharge side.

5. The apparatus of claim 4, further comprising frame means to which said foam generating means and pump are mounted.

6. The apparatus of claim 5, wherein said frame means is configured for placement in a stationary location from which said grout is pumped to said injection site.

7. The apparatus of claim 6, wherein said frame means is configured for rolling movement from a first location to a second location so as to permit said foam generating means and pump to be positioned adjacent said injection site.

8. The apparatus of claim 6, further comprising:

motor means for operating said pump; and power generating means mounted to said frame for selectively supplying power to operate said motor means.

9. The apparatus of claim 6, further comprising means for selectively flushing said grout out of said conduit means so as to prevent said grout from setting up therein.

10. The apparatus of claim 9, wherein said means for flushing said grout out of said conduit means comprises:

pump means mounted to said frame means for selectively generating a stream of water; and a conduit for directing said stream of water into said conduit means so that said stream of water flushes said grout out through a discharge end of said conduit means.

11. The apparatus of claim 4, wherein said means for feeding said cement slurry and said finished foam separately to said intake side of said pump means comprises:

a first supply line for feeding said slurry to said intake side of said pump at a first point thereon; and a second supply line for feeding said foam to said intake side of said pump at a second point thereon;

said first and second points on said intake side of said pump being spaced apart along said generally linear direction of flow therethrough.

12. The apparatus of claim 11, wherein said second point at which said finished foam is fed to said intake side of said pump is positioned downstream from said first point a sufficient distance to prevent said foam from bubbling up through said supply line which feeds said cement slurry to said pump.

13. The apparatus of claim 3, wherein said means for selectively adjusting said ratio at which said finished foam is mixed with said slurry further comprises:

control means for selectively adjusting a rate of operation of said positive displacement pump means so as to selectively adjust a rate at which said slurry is fed into said pump means and mixed with said finished foam therein.

14. The apparatus of claim of claim 4, wherein said means for selectively adjusting said ratio at which said finished foam is mixed with said slurry further comprises:

control means for selectively adjusting a rate of rotation at which said screw-type, progressive-cavity pump is operated, so as to selectively adjust a rate at which said slurry is fed into said pump means and mixed with said finished foam therein.

15. A method for the high capacity continuous generation and placement of a foamed cement grout, said method comprising the steps of:

providing a supply of cement slurry on a continuous basis;

generating a supply of finished foam on a continuous basis;

feeding said cement slurry and said finished foam substantially separately and on a continuous basis to an intake side of positive displacement pump means having (a) said intake side, (b) a discharge side, and (c) a body portion which is configured to mix said slurry and said foam therein as said foam and said slurry flow from said intake side to said discharge side thereof, so that said slurry and said foam are mixed within said body portion of said pump means so as to form said foamed cement grout on a continuous basis; and conveying said foamed cement grout through conduit means from said discharge side of said pump means to a selected injection site on a continuous basis.

16. The method of claim 15, further comprising the step of:

selectively adjusting a ratio at which said finished foam is mixed with said cement slurry on a continuous basis so as to compensate for observed variations in the quality of said grout.

17. The method of claim 16, wherein the step of selectively adjusting said ratio at which said finished foam is mixed with said slurry comprises:

selectively adjusting a rate at which said finished foam is outputted and mixed with said cement slurry.

18. The method of claim 17, further comprising the step of:

injecting said grout at said injection site at a sufficiently high rate that said injection site is filled continuously while avoiding injection of fresh grout under pressure adjacent previously-injected grout which has taken an initial set, so as to avoid collapse of void spaces in said previously-injected grout due to injection pressure of said fresh grout.

19. The method of claim 15, wherein the step of feeding said cement slurry and said finished foam to said intake side of said pump means comprises:

supplying said foam and said slurry to an intake side of a positive-displacement screw-type, progressive-cavity pump through which said slurry and said foam flow in a generally linear direction.

20. The method of claim 19, wherein the step of feeding said cement slurry and said finished foam separately to said intake side of said pump means comprises:

feeding said slurry through a first supply line to a first point on said intake side of said pump; and feeding said foam through a second supply line to a second point on said intake side of said pump;

said first and second points on said intake side of said pump being spaced apart along said generally linear direction of flow therethrough, and said second point at which said finished foam is fed to said intake side of said pump being positioned downstream from said first point a sufficient distance to prevent said foam from bubbling up through said supply line which feeds said cement slurry to said pump.

21. The method of claim 19, wherein the step of selectively adjusting said ratio at which said finished foam is mixed with said cement slurry comprises:

selectively adjusting a rate of rotation at which said screw-type, progressive-cavity pump is operated so as to selectively adjust a rate at which said slurry is fed into said pump means and mixed with said finished foam therein.

* * * * *